US009199178B2

(12) United States Patent
Knijpstra

(10) Patent No.: US 9,199,178 B2
(45) Date of Patent: Dec. 1, 2015

(54) ATTRACTION FOR AMUSEMENT RIDES

(71) Applicant: K.I.G. Heerenveen B.V., Terband-Heerenveen (NL)

(72) Inventor: Wytze Knijpstra, Tijnje (NL)

(73) Assignee: K.I.G. Heerenveen B.V., Terband-Heerenveen (NL)

( * ) Notice: Subject to any disclaimer, the term of this patent is extended or adjusted under 35 U.S.C. 154(b) by 0 days.

(21) Appl. No.: 14/151,380

(22) Filed: Jan. 9, 2014

(65) Prior Publication Data

US 2014/0194215 A1 Jul. 10, 2014

(30) Foreign Application Priority Data

Jan. 10, 2013 (NL) ..... 2010106

(51) Int. Cl.
*A63G 27/04* (2006.01)
*A63G 1/10* (2006.01)

(52) U.S. Cl.
CPC ..... *A63G 27/04* (2013.01)

(58) Field of Classification Search
CPC ..... A63G 1/00; A63G 1/10; A63G 1/26; A63G 9/00; A63G 9/08
USPC ..... 472/39, 43, 44, 45, 46, 47
See application file for complete search history.

(56) References Cited

U.S. PATENT DOCUMENTS

| | | | | |
|---|---|---|---|---|
| 4,643,416 | A | 2/1987 | van der Veen | |
| 5,188,566 | A * | 2/1993 | Bohme | 472/45 |
| 5,314,383 | A * | 5/1994 | Fabbri | 472/45 |
| 5,803,816 | A | 9/1998 | Moser et al. | |
| 5,941,777 | A * | 8/1999 | Moser et al. | 472/44 |
| 8,845,439 | B2 * | 9/2014 | Kroon et al. | 472/47 |
| 2004/0192453 | A1 | 9/2004 | Esparza | |

FOREIGN PATENT DOCUMENTS

| | | | |
|---|---|---|---|
| CN | 201150794 | A1 | 11/2008 |
| DE | 19543697 | A1 | 6/1996 |
| EP | 2517765 | A1 | 10/2012 |
| GB | 19198 | | 0/1912 |

* cited by examiner

*Primary Examiner* — Kien Nguyen
(74) *Attorney, Agent, or Firm* — Oppedahl Patent Law Firm LLC

(57) ABSTRACT

The present invention relates to an attraction (100) for amusement rides, such as a fairground attraction or an amusement park attraction. The attraction comprises two towers (101), each provided with a drivable arm (102) which is mounted rotatably on the tower. The attraction is provided with a number of gondolas (104), each with a number of seats (105), wherein each gondola is connected to the arms. According to the invention the attraction comprises at least one carrier arm (103) which extends between the arms (102) and each gondola (104) is connected to the carrier arm for rotation about at least one rotation axis (R1, R2) extending substantially transversely of the carrier arm.

9 Claims, 4 Drawing Sheets

ATTRACTION FOR AMUSEMENT RIDES

TECHNICAL FIELD

The present invention relates to an attraction for amusement rides, such as a fairground attraction or an amusement park attraction, comprising two towers, each provided with a drivable arm which is mounted rotatably on the tower, wherein the attraction is provided with a number of gondolas, each with a number of seats, wherein each gondola is connected to the arms.

BACKGROUND OF THE INVENTION

Such an attraction is known in the field. The known attraction comprises one gondola with several rows of seats which is mounted rotatably on either side on the arms. In the known attraction the seats can be rotated through 360 degrees about two independent rotation axes.

DISCLOSURE OF THE INVENTION

The known attraction has the drawback that it is only suitable for older children and adults who comply with the applicable tallness requirements.

The present invention has for its object to provide an attraction of the type stated in the preamble which is spectacular and suitable for all ages.

The attraction according to the invention has for this purpose the feature that the attraction comprises at least one carrier arm which extends between the arms and that each gondola is connected to the carrier arm for rotation about at least one rotation axis extending substantially transversely of the carrier arm.

The attraction according to the invention provides an additional degree of freedom of movement which results in a spectacular combination of rotation movements and provides a passenger with a unique experience.

In a first preferred embodiment each gondola is connected rotatably to the carrier arm by means of two independent rotation shafts extending substantially transversely of the carrier arm. The attraction according to the first preferred embodiment provides a further additional degree of freedom of movement which results in an even more spectacular combination of rotation movements and provides a passenger with an intense experience.

According to a practical preferred embodiment, the gondolas are grouped in gondola crosses, and each gondola cross is connected to the carrier arm for rotation about a rotation axis extending substantially transversely of the carrier arm. According to the further development of this practical preferred embodiment, each gondola is connected to the gondola cross for rotation about a further rotation axis extending substantially transversely of the gondola cross.

In a second preferred embodiment at least one arm consists of two pivotally connected sub-arms and the carrier arm is connected by means of universal joints to the drivable arms. According to a further development of the second preferred embodiment, the tower provided with the pivotally connected sub-arms is disposed inclining in the direction toward the other tower. An inclining position of the carrier arm can hereby be obtained in advantageous manner without making the carrier arm longer. The inclining position of the carrier arm results in a spectacular combination with the rotation movements, and in an even more intense experience.

The rotation shafts providing additional degrees of freedom of movement can take a freely rotatable or drivable form as desired. The more drivable rotation shafts there are, the more intense the experience will be. These options enable the attraction to be made suitable for different target groups.

BRIEF DESCRIPTION OF THE DRAWINGS

The invention will now be described in more detail with reference to the figures.

BEST MODE FOR CARRYING OUT THE INVENTION

Figure 1A:
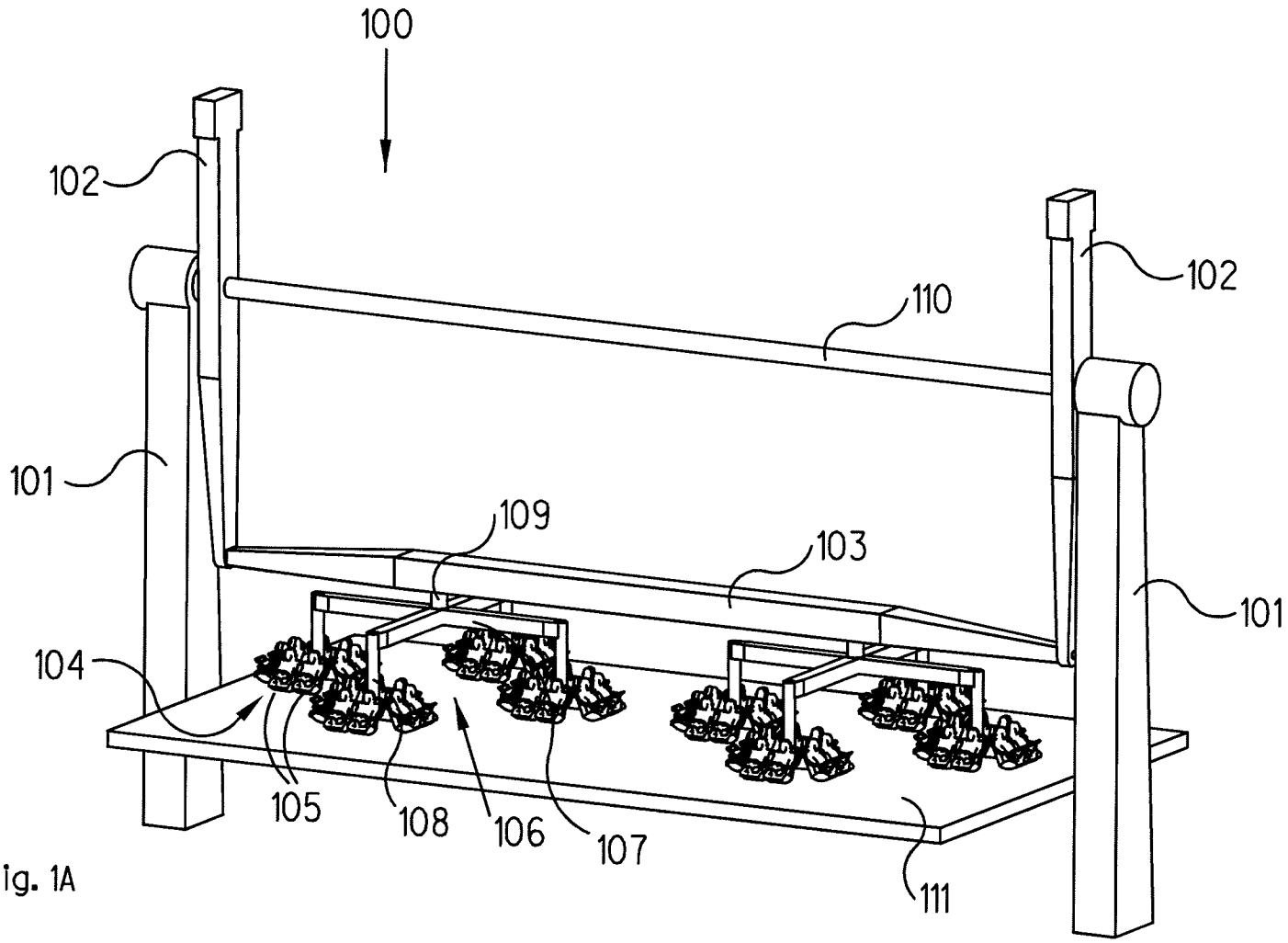
FIGS. 1A and 1B show a first preferred embodiment of the attraction according to the invention in two different positions.
Figure 1B:
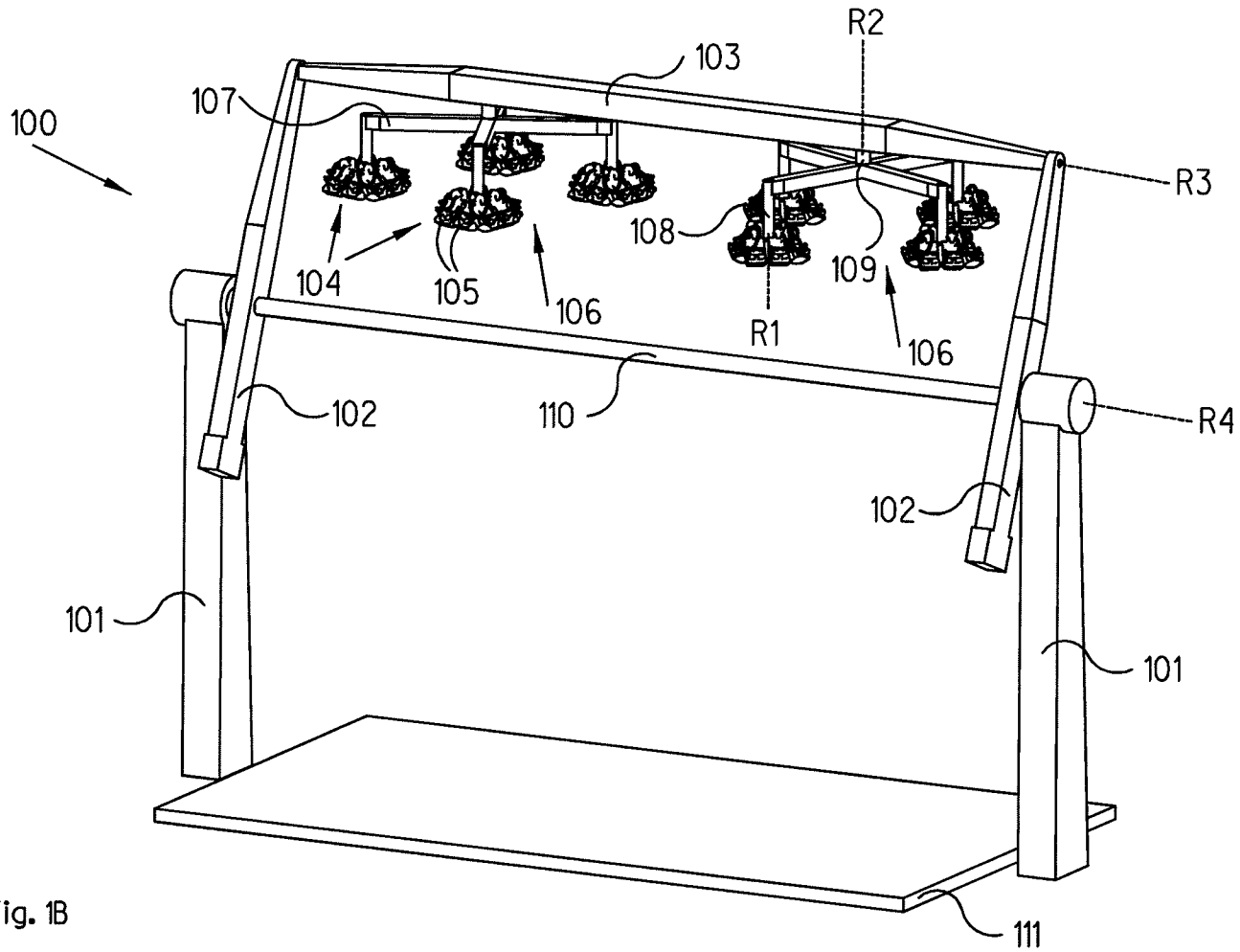

FIG. 1A shows attraction 100 in the lowest position. This is also the starting position and end position, and thereby the embarkation and disembarkation position. FIG. 1B shows attraction 100 in operation in a higher position. Attraction 100 comprises two towers 101 placed in the same orientation some distance from each other on a ground surface. Towers 101 are preferably identical. Each tower 101 is provided with an arm 102 mounted rotatably on tower 101 by means of a suitable coupling. Present in tower 101 is a drive for driving the arm 102. Arms 102 are preferably identical. Arms 102 extend substantially parallel to towers 101 in the rest position. The plane in which arms 102 rotate extends substantially perpendicularly of the plane in which towers 101 extend.

Extending between arms 102 is a carrier arm 103 which is connected rotatably on either side to arms 102, preferably at the position of the outer ends thereof. One or more gondolas 104 are attached to carrier arm 103. Each gondola 104 is provided with seats 105. In the shown preferred embodiment eight gondolas 104 are attached to carrier arm 103. Eight seats 105 are present in each gondola 104. The capacity per ride amounts in this preferred embodiment to 64 seats.

Attraction 100 is further provided with a platform 111 for embarkation and disembarkation between rides.

Each gondola 104, and thereby each seat 105, is connected rotatably to carrier arm 103 via two independent rotation shafts extending substantially transversely of carrier arm 103. In the shown preferred embodiment 100 this is achieved by grouping the gondolas 104 in gondola crosses 106 which are each mounted rotatably on the carrier arm by means of a gondola cross shaft 109. Each gondola cross 106 is formed by two or more gondola cross arms 107 in crosswise arrangement. Extending on the outer end of each gondola cross arm 107 is a gondola arm 108 on which a gondola 104 is rotatably mounted. In the shown preferred embodiment the gondola arms 108 lie substantially perpendicularly of the gondola cross arms 107. The gondola cross shafts 109 lie substantially perpendicularly of carrier arm 103.

Drawn in FIG. 1B are the rotation axes around which a passenger in a seat 105 will rotate during a ride. The first rotation axis R1 extends in longitudinal direction through gondola arms 108. Each gondola 104 is mounted on the associated gondola arm 108 for rotation around the first rotation axis R1. The second rotation axis R2 extends in longitudinal direction through the gondola cross shaft 109 with which each gondola cross 106 is rotatably mounted on carrier arm 103. The third rotation axis R3 extends in longitudinal direction through carrier arm 103 which is mounted rotatably on the outer ends of arms 102. The fourth rotation axis R4 extends between towers 101, or more precisely between the rotation points at which arms 102 are connected to towers 101. It is noted that in the shown preferred embodiment 100 a connecting shaft 110 is arranged at the position of the rotation axis R4. This connecting shaft ensures a synchronous movement of arms 102 even if one of the drives in towers 101 were to fail.

Figure 2A:
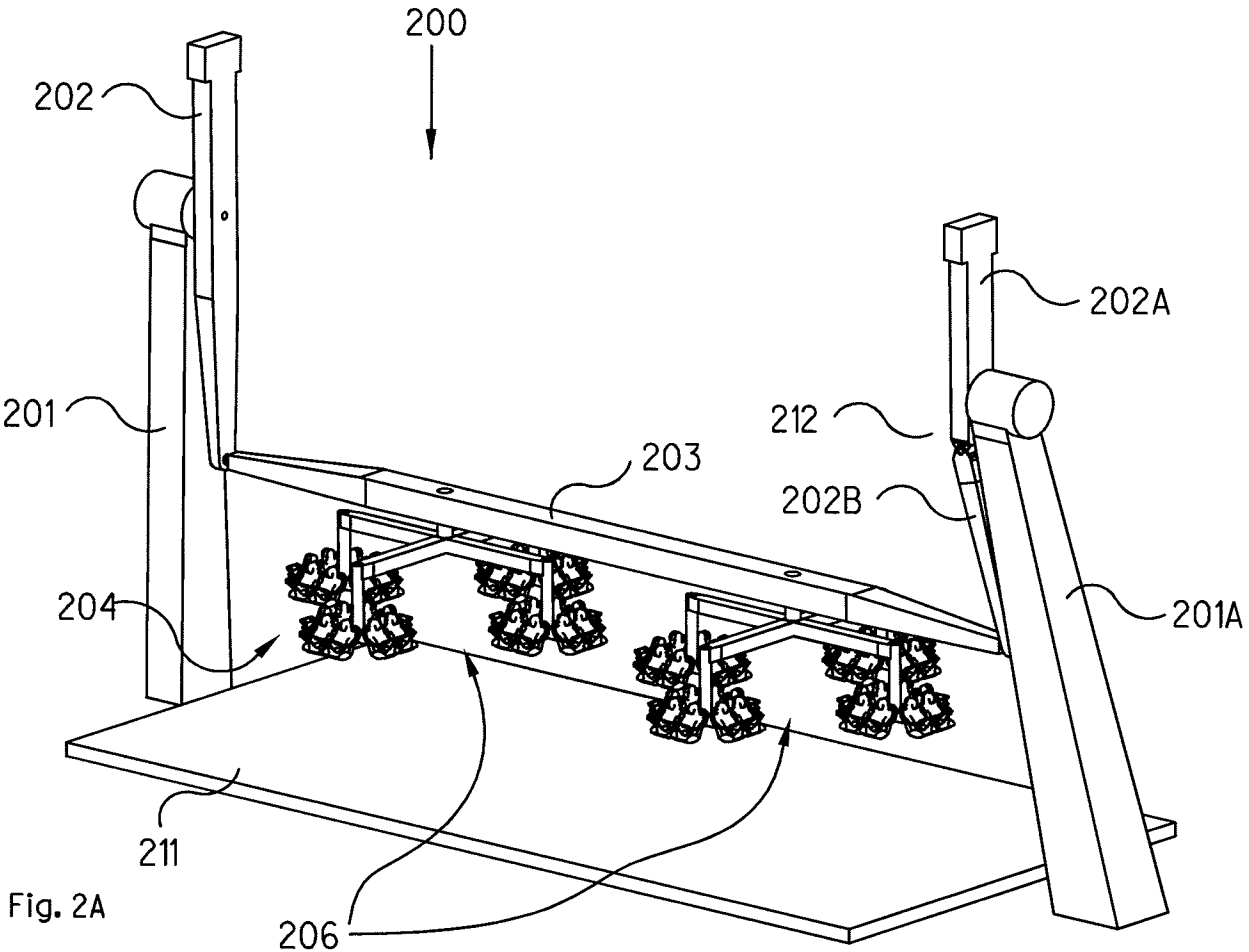
FIGS. 2A and 2B show a second preferred embodiment of an attraction according to the invention in two different positions.
Figure 2B:
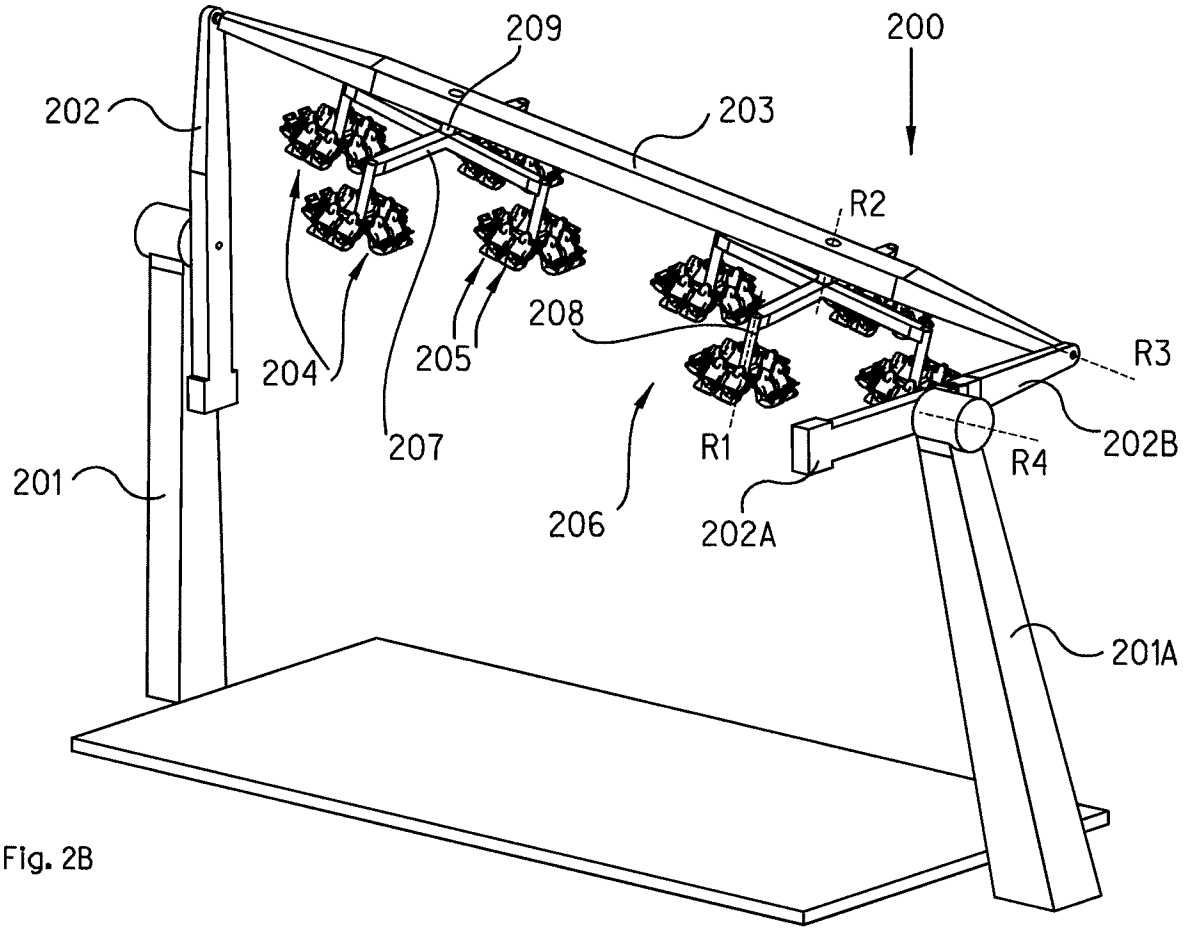

FIG. 2A shows a second preferred embodiment of an attraction 200 in the lowest position. FIG. 2B shows attraction 200 in operation in a higher position. Attraction 200 comprises a large number of components corresponding to the shown and described components of attraction 100. The same components are provided with the same reference numerals increased by 100.

The most important differences between attraction 200 and attraction 100 are to be found in the connecting arms 202 and towers 201. One of the two towers 201A is disposed inclining to some extent in the direction toward the other tower 201. The inclining tower 201A is provided with a connecting arm 202 consisting of two parts 202A and 202B. Parts 202A and 202B are connected pivotally to each other by means of a hinge 212. The two arms 202 are drivable separately of each other, also in opposite directions. This adds an additional sensation to the amusement rides. This additional sensation is caused by an inclining position of carrier arm 203 which can occur during the amusement rides. This is illustrated in FIG. 2B.

The attraction according to the invention gives each passenger movement along three or four degrees of freedom of movement as desired. It is the case for both preferred embodiments 100 and 200 that rotation about rotation axis R4 is always driven and that rotation about the other rotation axes R1, R2 and R3 can take a drivable as well as a freely rotatable form as desired. An additional sensation can be added to the attraction by having the gondolas and/or the gondola crosses rotate 360 degrees round rotation axis R3. This is possible by actively driving the rotation of carrier arm 103, 203 or by arranging a counterweight (not shown) on carrier arm 103, 203. If on the contrary the intensity of the experience has to be reduced, one of the rotation axes R1 or R2 can be dispensed with.

It is noted that suitable drives, universal joints, flexible couplings and hinges are per se known in the relevant field.

It will be apparent that the capacity of the attraction according to the invention can be modified to the circumstances. This is possible by modifying the number of seats per gondola, the number of gondolas per gondola cross and the number of gondola crosses per carrier arm, or even the number of carrier arms. In addition, it is also possible to dispense with the use of gondola crosses and to mount the gondolas directly for rotation on the carrier arms, or even to dispense with gondolas and to mount the seats directly for rotation on the carrier arms. All these variants lie within the reach of a skilled person following reading of this text.

The invention is not therefore limited to the described and shown preferred embodiments, but extends to any embodiment falling within the scope of protection as defined in the claims and as seen in the light of the foregoing description and accompanying drawings.

The invention claimed is:

1. Attraction for amusement rides, comprising two towers, each provided with a drivable arm which is mounted rotatably on the tower, wherein the attraction is provided with a number of gondolas, each with a number of seats, wherein each gondola is connected to the arms, characterized in that the attraction comprises at least one carrier arm which extends between the arms and is connected rotatably on either side to the arms, at the position of the outer ends thereof, and that each gondola is connected to the carrier arm for rotation about at least one rotation axis extending substantially transversely of the carrier arm.

2. Attraction as claimed in claim 1, wherein each gondola is connected rotatably to the carrier arm by means of two independent rotation shafts extending substantially transversely of the carrier arm.

3. Attraction as claimed in claim 2, wherein the gondolas are grouped in gondola crosses, and wherein each gondola cross is connected to the carrier arm for rotation about a rotation axis extending substantially transversely of the carrier arm.

4. Attraction as claimed in claim 3, wherein each gondola is connected to the gondola cross for rotation about a further rotation axis extending substantially transversely of the gondola cross.

5. Attraction as claimed in claim 2, wherein one or more of the rotation shafts is freely rotatable.

6. Attraction as claimed in claim 2, wherein one or more of the rotation shafts is drivable.

7. Attraction as claimed in claim 1, wherein at least one arm consists of two pivotally connected sub-arms and the carrier arm is connected by means of universal joints to the arms.

8. Attraction as claimed in claim 7, wherein the tower provided with the pivotally connected sub-arms is disposed inclining in the direction toward the other tower.

9. Attraction as claimed in claim 1, wherein the attraction is a fairground attraction or an amusement park attraction.

* * * * *